US009440279B2

(12) United States Patent
Marcon

(10) Patent No.: US 9,440,279 B2
(45) Date of Patent: Sep. 13, 2016

(54) PUNCH FOR CRIMPING TOOL, AND CRIMPING TOOL PROVIDED WITH SUCH A PUNCH

(71) Applicant: ETABLISSEMENTS PIERRE GREHAL ET CIE SA, Baillet-en-France (FR)

(72) Inventor: Lionel Marcon, Parmain (FR)

(73) Assignee: ETABLISSEMENTS PIERRE GREHAL ET CIE SA, Baillet-en-France (FR)

( * ) Notice: Subject to any disclaimer, the term of this patent is extended or adjusted under 35 U.S.C. 154(b) by 0 days.

(21) Appl. No.: 14/591,207

(22) Filed: Jan. 7, 2015

(65) Prior Publication Data

US 2015/0190858 A1 Jul. 9, 2015

(30) Foreign Application Priority Data

Jan. 7, 2014 (FR) ..... 14 50104

(51) Int. Cl.
*B21D 39/03* (2006.01)
*B25B 7/02* (2006.01)
*B25B 7/12* (2006.01)

(52) U.S. Cl.
CPC ..... *B21D 39/035* (2013.01); *B25B 7/02* (2013.01); *B25B 7/12* (2013.01)

(58) Field of Classification Search
CPC ... B21D 39/034; B25B 27/146; B25B 27/31; E04F 21/1855
USPC ..... 29/243.5, 243.58
See application file for complete search history.

(56) References Cited

U.S. PATENT DOCUMENTS 3,925,875 A * 12/1975 Doke ..... B21D 39/034 29/21.1
4,593,443 A * 6/1986 Wolford ..... B25B 27/146 29/243.5
4,670,957 A * 6/1987 Wolford ..... B25B 31/00 29/243.5
4,893,493 A * 1/1990 Jacques ..... B25B 27/146 29/243.5
4,989,438 A * 2/1991 Simon ..... B25B 27/146 227/119
5,333,483 A * 8/1994 Smith ..... B25B 27/146 29/243.5
5,937,690 A * 8/1999 Pomerleau ..... E04F 21/1855 29/243.5
6,705,147 B2 * 3/2004 Judge ..... B21D 39/034 29/243.58

FOREIGN PATENT DOCUMENTS

FR 2969951 7/2012

* cited by examiner

*Primary Examiner* — David B Jones
(74) *Attorney, Agent, or Firm* — Clark & Brody

(57) ABSTRACT

The present invention proposes a crimping punch making it possible to obtain a crimping that is resistant to pulling out. To this end, the punch (20) comprises a fixing part (21) for fixing to the tool and a punching part (22) consisting of a spike (23) connected to the fixing part by a first (24) and a second (25) crimping face, the first crimping face (24) exhibiting a convex primary profile and a secondary profile comprising at least two teeth (241, 251), preferably between three and five teeth, advantageously three teeth.

16 Claims, 5 Drawing Sheets

Figure 7:
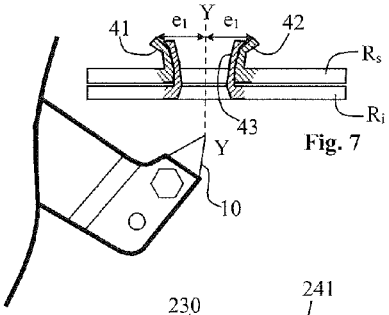

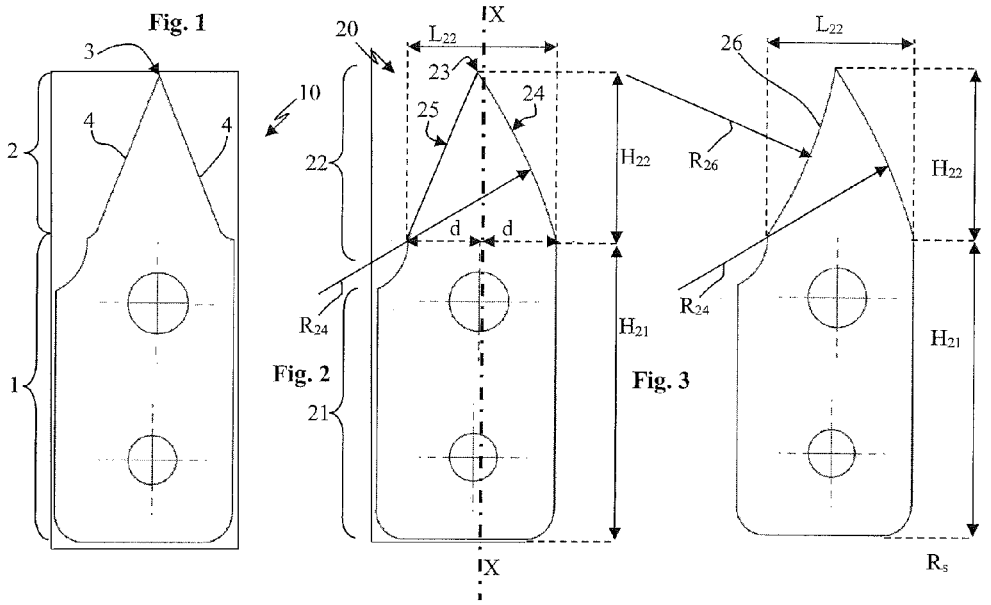
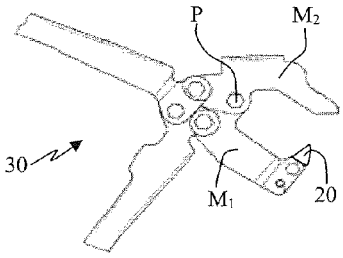
Fig. 4
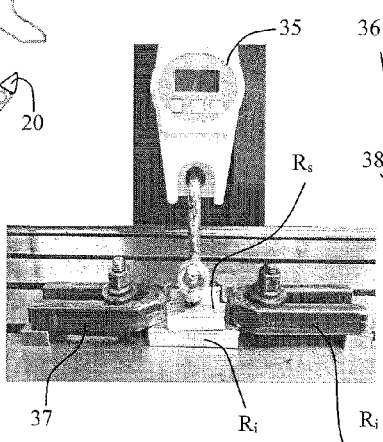
Fig. 5
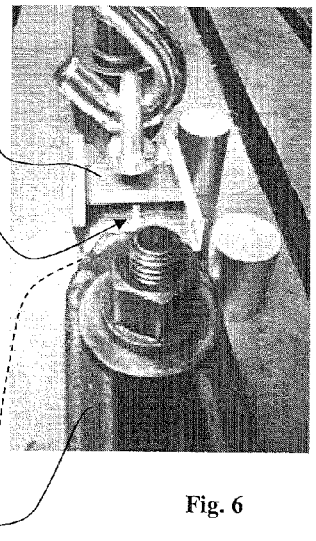
Fig. 6

Fig. 16
| Type of punch | |
|---|---|
| E1 | 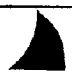 |
| E2 | 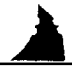 |
| E3 | 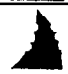 |
| E4 | 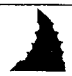 |
| E5 | 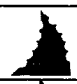 |
| E6 | 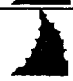 |
| E7 | 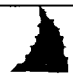 |
| E8 | 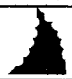 |
| E9 | 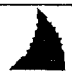 |

PUNCH FOR CRIMPING TOOL, AND CRIMPING TOOL PROVIDED WITH SUCH A PUNCH

The invention relates to a punch for a crimping tool, such as a pair of crimping pliers, for assembling two components by crimping them together. In particular, these components are advantageously open metal section pieces placed one against the other and used, notably, in certain structures or frameworks for assembling sheets of plasterboard, as walls or as ceilings.

Conventionally, the metal section pieces used are U-sections.

In general, such metal section pieces do not work greatly in shear, and this means that crimping is enough to hold them together. Nevertheless, during certain setups, it may happen that the crimpings are heavily loaded and pull out. This is why U-sections nested one inside the other are generally used so that the flanges of each section piece hold the other section piece.

For example, when a false ceiling is being installed, U-sections are fixed high up around the periphery of the room in such a way that the web of each section piece is fixed to the wall by firm fasteners such as screws or drift bolts.

In this position, the flanges of each section piece are parallel to one another and parallel to the ground. Other U-sections are then inserted between the flanges of two U-sections fixed to opposite walls. Thus, the second section pieces run perpendicular to the first and are held by the flanges of the first section pieces.

In order to prevent the second section pieces from moving when sheets of plasterboard are screwed to their underside, the section pieces are crimped together using crimping pliers.

The use of U-sections around the periphery of the room is necessary in order to retain the second section pieces in an upwards direction while the screwing is imparting an upwards force to the second section pieces.

If the crimped joints were firm enough, there would be no need to use U-sections and far less expensive angle brackets could simply be used.

It is therefore one of the objectives of the present invention to propose a crimping punch that allows a crimped joint to be obtained that is more resistant to pulling out than the crimped joints known to date.

Another objective is to obtain such more resistant crimping but for a crimping force that is the same as or even lower than the crimping force needed to crimp together two section pieces using crimping pliers of the prior art.

To that end, one subject of the invention is a punch for a crimping tool, comprising a fixing part for fixing to the tool and a punching part consisting of a spike connected to the fixing part by a first and a second crimping face, in which the first crimping face exhibits a convex primary profile and a secondary profile comprising at least two teeth, preferably between three and five teeth, advantageously three teeth.

The primary profile, or order-1 profile, is the overall profile of the face. The latter may further comprise a secondary profile, or order-2 profile, made up of roughnesses or steps.

According to other embodiments:

- the second crimping face may exhibit a rectilinear primary profile;
- the second crimping face may exhibit a concave primary profile;

- the spike may be centred with respect to the first and second crimping faces;
- the punching part may exhibit a height of between 1 and 2 cm, preferably 1.4 cm, a width of between 1 and 2 cm, preferably 1.4 cm, and the convex first crimping face exhibits a radius of convex curvature of between 4 and 6 cm, preferably 5 cm;
- the concave second crimping face may exhibit a radius of concave curvature of between 3 and 4 cm, preferably 3.7 cm;
- each crimping face may exhibit a secondary profile comprising at least two teeth, preferably between three and five teeth, advantageously three teeth; and/or
- the teeth may be spaced each from the other by a concave notch exhibiting a radius of concave curvature of between 1.5 and 3 mm, preferably between 2.5 and 3 mm.

Another subject of the invention is a crimping tool for crimping two components together, comprising two jaws articulated one with respect to the other relative to a pivot, between an open position for positioning them one on each side of the components that are to be crimped, and a closed position at the end of crimping, characterized in that one of the jaws bears a punch according to the invention and the other jaw exhibits a die that accommodates the punch when the two jaws are in the closed position.

According to other embodiments:

- the punch may be configured in such a way that the spike is positioned between the pivot and the convex first crimping face;
- the crimping tool may further comprise two handles connected to the jaws so that the jaws can be operated by hand.

Figure 8:
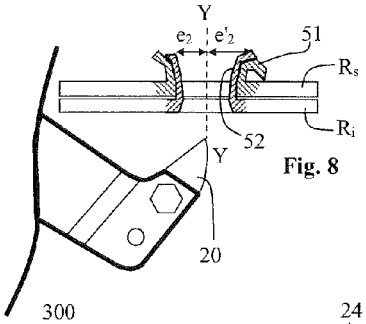
Figure 9:
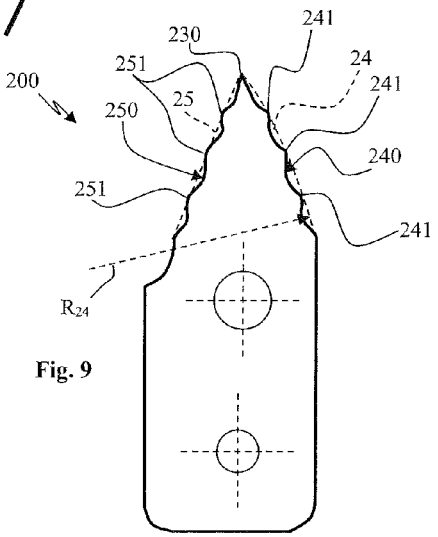
Figure 10:
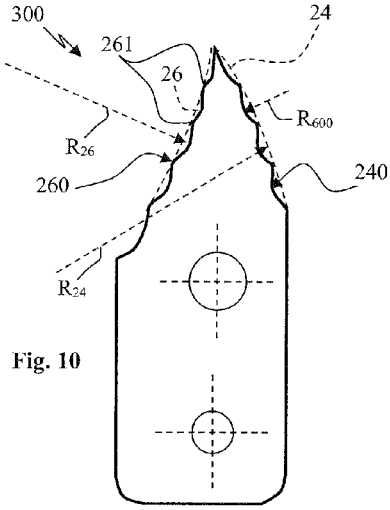
Figure 11:
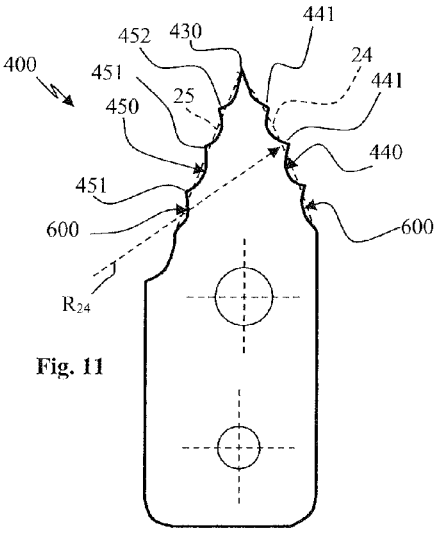
Figure 12:
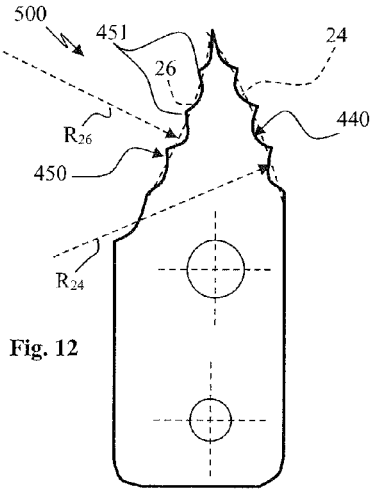
Figure 13:
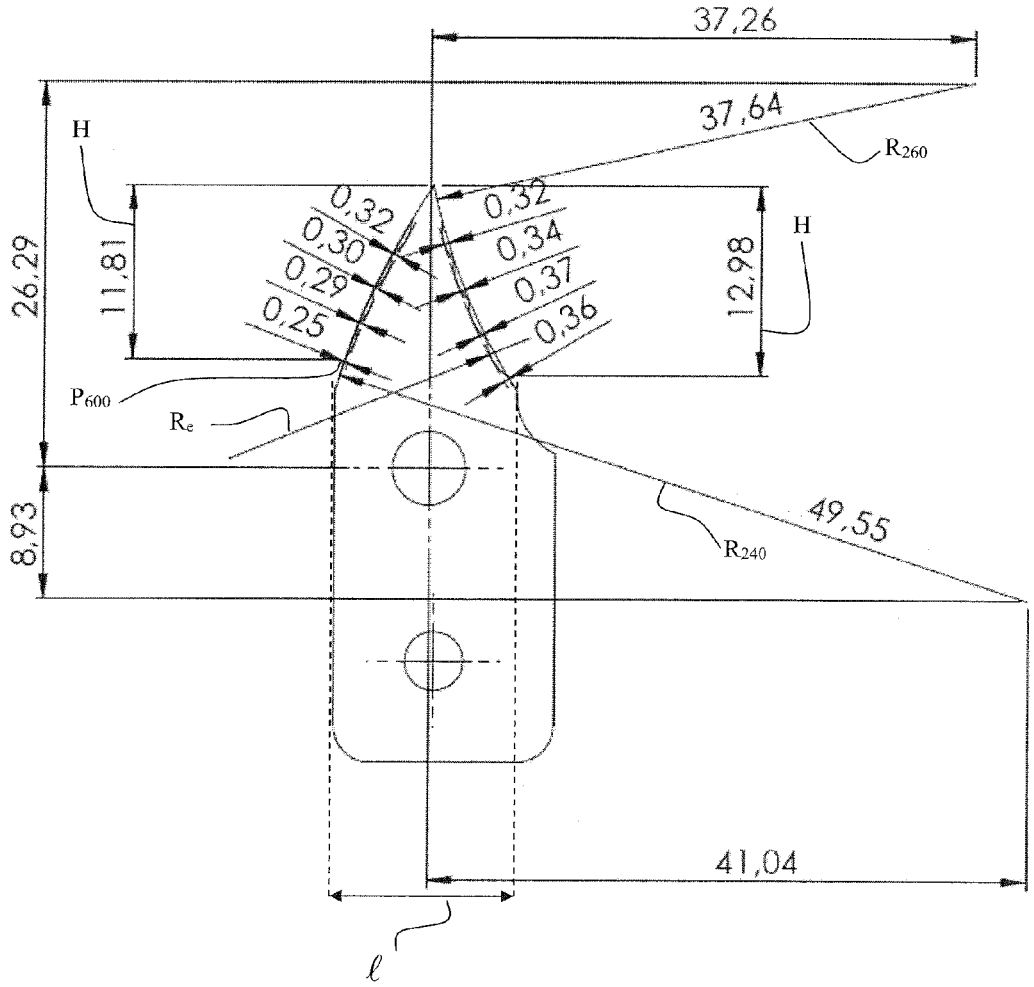
Figure 14:
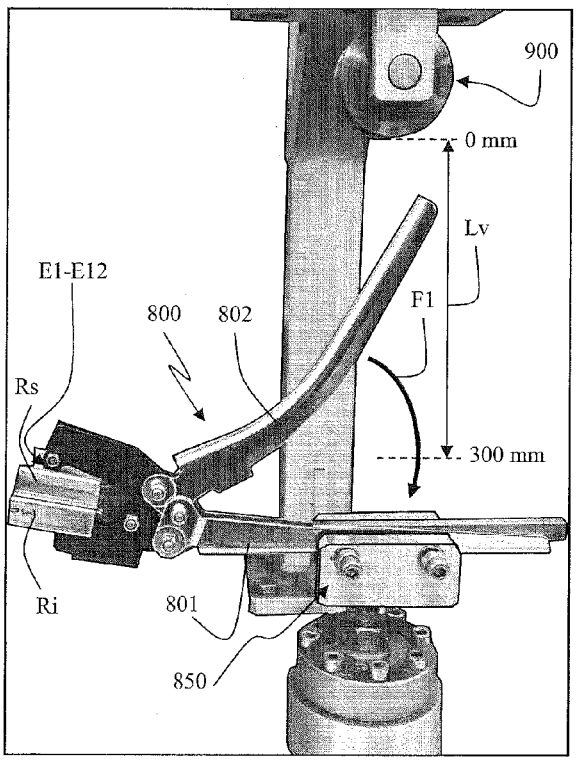
Figure 15:
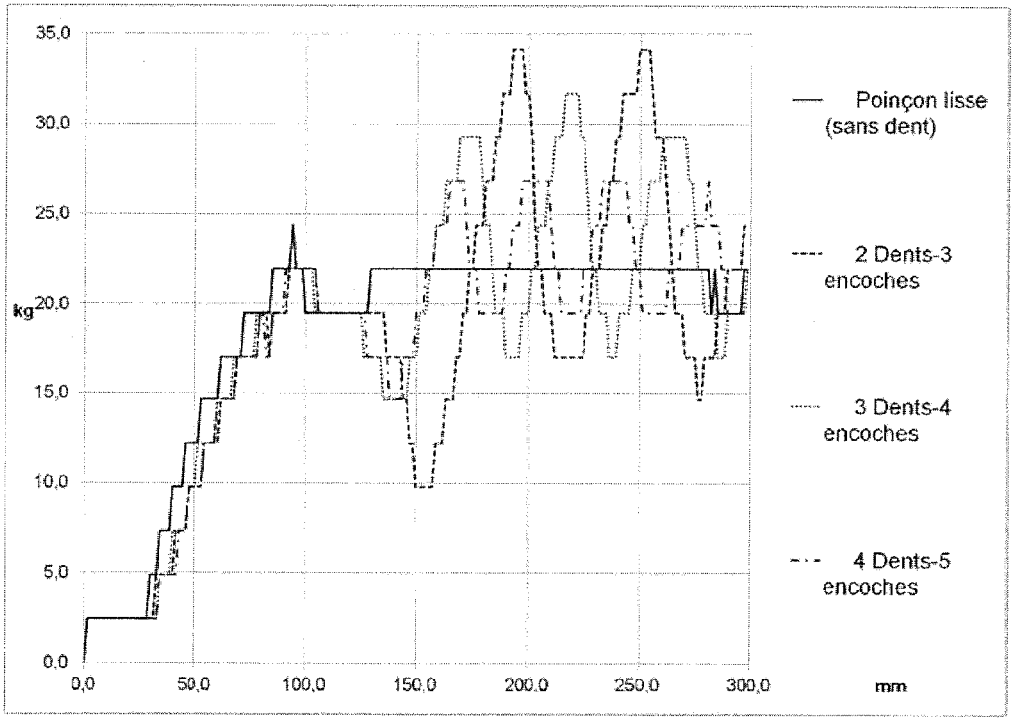

Other features of the invention will be listed in the detailed description hereinafter given with reference to the attached drawings which, respectively, depict:

FIG. 1: a schematic plan view of a punch of the prior art;

FIG. 2: a schematic plan view of a first embodiment of a punch according to the invention;

FIG. 3: a schematic plan view of a second embodiment of a punch according to the invention;

FIG. 4: a schematic plan view of a pair of crimping pliers of the prior art, fitted with a punch according to the invention;

FIGS. 5 and 6: photographs, respectively face-on and side-on, of a setup for measuring the pull-out resistance of crimped joints made using a punch according to the invention;

FIG. 7: a schematic view in cross section of a crimped joint obtained with a punch of the prior art;

FIG. 8: a schematic view in cross section of a crimped joint obtained with a punch according to the invention;

FIG. 9: a schematic plan view of a third embodiment of a punch according to the invention;

FIG. 10: a schematic plan view of a fourth embodiment of a punch according to the invention;

FIGS. 11 and 12: schematic plan views of alternative forms of the embodiments of FIGS. 9 and 10 respectively;

FIG. 13: a schematic plan view of one embodiment of a toothed punch according to the invention suited to the hand tools on the market, showing manufacturing dimensions;

FIG. 14: a face-on photograph of a setup for measuring the force necessary for crimping performed using a punch according to the invention; and FIG. 15: curves of the force required for crimping as a function of a travel Lv of the actuating cylinder of the setup of FIG. 14 and of the punches according to the invention having different numbers of teeth.

FIG. 16: illustrations of the punch configurations E1-E9 used in pullout tests.

As FIG. 1 shows, a punch of the prior art 10 comprises a fixing part 1 for fixing to a crimping tool (not illustrated), and a punching part 2 consisting of a spike 3 connected to the fixing part 1 by two rectilinear crimping faces 4.

FIG. 2 illustrates a first embodiment of a punch according to the invention. This punch 20 comprises a fixing part 21 for fixing to a crimping tool and a punching part 22 consisting of a spike 23 connected to the fixing part 21 by a first crimping face 24 and a second crimping face 25.

According to the invention, the first crimping face 24 is convex, i.e. is domed towards the outside of the punch and, therefore, has a length greater than the length of the rectilinear second crimping face 25.

In the embodiment illustrated, the punching part 22 has a height $H_{22}$ of between 1 and 2 cm and, in this instance, of around 1.4 cm.

The punching part 22 also has a width $L_{22}$ considered at the point where the punching part and the fixing part meet, of between 1 and 2 cm and, in this instance, of around 1.4 cm.

The first crimping face 24 exhibits a radius of convex curvature $R_{24}$ of between 4 and 6 cm and, in this instance, of around 5 cm.

The fixing part comprises, at its base, a width $L_{21}$ of around 1.5 cm.

As in the prior art, the fixing part 21 comprises two fixing holes for the passage of nuts for fixing to the crimping tool.

Such a crimping tool may, for example, be a pair of crimping pliers like those described in patent FR-2969951.

FIG. 3 illustrates a second embodiment of a punch according to the invention, in which the second crimping face 26 is concave.

Advantageously, this concave second face 26 has a radius of concave curvature $R_{26}$ of between 3 and 4 cm. In the drawing of FIG. 3, this radius $R_{26}$ is equal to around 3.7 cm, the other parts of the punch having the same dimensions as those given in conjunction with FIG. 2.

In the two embodiments of FIGS. 2 and 3, the spike 23 is centred with respect to the first and second crimping faces. In other words, the longitudinal axis XX of the punch passing through the spike 23 is situated at equal distances d from the crimping faces in the region of the junction between the crimping part 22 and the fixing part 21.

The radius of curvature of the crimping faces 24 and 25 needs to be adapted to suit the distance between the punch and the pivot P on which the jaws $M_1$ and $M_2$ of the crimping tool are articulated (see FIG. 4).

FIG. 4 illustrates a crimping tool 30 according to the invention for crimping two components together. This tool comprises two jaws $M_1$ and $M_2$ articulated with respect to one another relative to a pivot P.

In FIG. 4, the jaws are in the open position so that they can be positioned one on each side of the components that are to be crimped.

One of the jaws, $M_1$, bears a punch 20 according to the invention. The other jaw $M_2$ bears a die that accommodates the punch when the two jaws $M_1$ and $M_2$ are in the closed position at the end of crimping.

According to the invention, the punch 20 is configured on the crimping tool in such a way that the spike 23 is positioned between the pivot P and the convex first crimping face 24.

In other words, in FIG. 4, the convex first crimping face 24 is situated towards the outside of the pliers whereas the second crimping face 25 or 26 is situated towards the inside, i.e. facing towards the pivot P, of the crimping pliers.

Because of the convexness of one of the crimping faces of the punch according to the invention, crimped joints that are far more resistant to pulling out are obtained.

Thus, as FIGS. 5 and 6 illustrate, pull-out resistance experiments were conducted using a Kern model HCB hanging scale 35 version 3.1 7/2006.

The setup tested consisted of a U-shaped top rail $R_s$ with a length of 70 mm, width of 48 mm and sheet metal thickness of 0.7 mm.

The rail $R_s$ comprises lateral flanges 15 mm tall and lips facing towards the inside of the rail and parallel to the web of the U-shaped rail measuring 5 mm. The lips hold onto the block connected to the strength tests during measurements.

The U-shaped bottom rail $R_i$ has a length of 110 mm, a width of 48 mm, a sheet metal thickness of 0.7 mm, and flanges 15 mm tall.

The top rail $R_s$ and bottom rail $R_i$ were crimped together by a single crimped joint (referenced 38 in FIG. 6) centred on the rails, i.e. in the middle of the web of the U-section, equal distances from the flanges.

Such rails are conventionally used in the construction of plasterboard walls.

The hanging scale was fixed to the top rail $R_s$ by a fixing plate 36 wedged under the lips of the rail and the bottom rail was immobilised on the support by two fixing pieces 37.

The hanging scale was connected to a hydraulic arm (not illustrated) moving vertically upwards in order to generate a pull-out force on the two rails.

Measurements were taken over two tests for each type of punch. The results are reported in the table below.

| | Force required for puffing out (N) | |
|---|---|---|
| Type of punch | Test 1 | Test 2 |
| Punch of the prior art | 25 | 27 |
| Punch with convex face | 57 | 67 |

This table shows that a punch of the prior art requires a force of between 25 and 27 newtons in order to pull the two rails apart. With a punch comprising a convex face, the force needed to separate the two rails is in excess of 40 newtons and, more specifically, is between 57 and 67 newtons.

The improvement percentage differences can be explained by numerous factors, such as the speed of crimped joints (which are performed by hand), the number of crimped joints made beforehand (the temperature of is the punch can increase greatly after a number of crimping operations, it being possible for this temperature to have an influence over the quality of the next crimping operation) etc. Nevertheless, in all the comparative tests carried out, the punch according to the invention makes it possible to obtain crimped joints that are more resistant to being pulled out than those obtained with a punch of the prior art.

The convex face therefore allows the force necessary for pulling crimped joints apart to be increased significantly.

The crimped joints obtained with a punch of the prior art and with a punch according to the invention exhibit very different structures. These structures are illustrated in FIGS. 7 and 8.

In FIG. 7, the crimped joint obtained with a punch according to the prior art is substantially symmetric with respect to the median axis YY of the crimped joint. The bars 41 and 42 of the top rail $R_s$ are parted by a distance $e_1$ with respect to the centre of the crimped joint embodied by the axis YY in FIGS. 7 and 8.

A crimped joint obtained using a punch according to the invention is asymmetric and, where the convex crimping face has passed, exhibits a looping structure, which means to say that the barb 51 of the top rail $R_s$ is rolled over on itself and touches the top rail $R_s$.

Furthermore, the barb 52 of the bottom rail $R_i$ is folded over far more than the barb 43 of the bottom rail $R_i$ obtained using a punch of the prior art. It is distanced from the axis YY by a distance $e'_2$ which is greater than the distance $e_2$.

It is this rolling of the material of the crimped structures obtained with a punch according to the invention that increases the force required to pull the two rails apart.

The nominal values for the distances of separation of the barbs are dependent on the rails crimped. This is because a thick rail will not allow the barbs to roll over completely. What is important is that for the same rails crimped joints obtained using a punch according to the invention are curved over towards the outside of the crimping hole to a greater extent than the crimped joints obtained with a punch of the prior art. Of course, there may be variations caused by other parameters, such as the crimping speed and the temperature of the punch.

In order to limit the force required for crimping, i.e. the force that the user has to apply in order to bring the two jaws together, the punch according to the invention makes provision for the other crimping face to be concave. Thanks to that, and despite the presence of the convex face, a punch is obtained that allows crimping that requires a crimping force that is the same as or even slightly less than the crimping force that has to be used with a punch of the prior art.

Advantageously, in order to achieve this maintaining or reducing of the force required for crimping, the punch is configured in such a way that the spike is positioned between the pivot and the convex first crimping face. In other words, the concave second crimping face lies between the spike and the pivot.

Very strong crimped joints can thus be obtained using conventional crimping hand pliers.

FIGS. 9 and 10 illustrate the possibility of equipping the crimping faces of a curved punch according to the invention with teeth, advantageously of equipping at least one of the crimping faces of a curved punch according to the invention with teeth.

Triangular punches the crimping faces of which are straight and each provided with a tooth located between two notches already exist in the prior art.

Toothed punches have been used only little because the force required for crimping has been 50% higher than with a punch the crimping faces of which are planar and smooth (have no teeth).

Thanks to the solution, proposed by the invention, of curving the punch (by making provision for at least one of the crimping faces to be convex) and of equipping this punch with teeth, it is possible to multiply the effort needed for divestment (pulling the crimped joint apart) by a factor of between 4 and 6.5 by comparison with a plain smooth curved punch (with no teeth).

Thus, FIGS. 9 and 10 illustrate punches similar to the punches of FIGS. 2 and 3, except that the crimping faces 240, 250 and 260 have been machined to create teeth. Thus, the convex faces 24 (FIGS. 9 and 10), the planar face 25 (FIG. 9) and the concave face 26 (FIG. 10), all of them illustrated in dotted line in the figures, are no longer plain and smooth, but toothed.

In the embodiments illustrated, machining has removed material from the punch so that the tops of the teeth of the faces 240, 250 and 260 are tangential to the convex, straight and concave virtual planes formed by the said faces 24, 25 and 26 respectively.

The removal of material is done in such a way as to cut the crimping faces into concave notches 600 of determined radius of concave curvature Re.

A punch according to the invention suitable for the hand tools on the market exhibits (see FIG. 13) a punching part:

- of height H (considered between the spike and the junction between the punching part and the fixing part) of between 11 and 13 mm
- of width l, considered at the junction between the punching part and the fixing part, of between 1 and 2 cm and, in this instance, of around 1.4 cm.

The first crimping face 240 has a radius of convex curvature $R_{240}$ of between 4 and 6 cm. In the drawing of FIG. 13, this radius $R_{240}$ is equal to around 5 cm.

The concave second face 260 exhibits a radius of concave curvature $R_{260}$ of between 3 and 4 cm. In the drawing of FIG. 13, this radius $R_{260}$ is equal to around 3.7 cm.

The other dimensions of the punch are directly visible in FIG. 13 and are given in millimetres.

For example, for such a punch, a drill bit with a radius of between 1.5 mm and 3 mm, preferably between 2.5 mm and 3 mm, is used to remove material from the punch.

The concave notches 600 in FIG. 13 are made with a drill bit with a radius Re of 3 mm, to a depth P600 of between 0.2 mm and 0.4 mm, preferably between 0.25 mm and 0.37 mm, and typically of 0.3 mm.

The notches of one and the same punch, or even of one and the same face may have depths $P_{600}$ that are the same or different, as illustrated in FIG. 13 where the four notches on each face 240-260 have different depths $P_{600}$.

This removal of material needs to be done in such a way that the tip of the teeth is curved slightly to ensure that the material rolls during the crimping operation. If the tip of the teeth is too sharp, i.e. if the spike is too pointed, there is a risk that the material will be cut during crimping, thus diminishing the pull-out strength of the crimped joint.

Alternatively, in the embodiments of FIGS. 11 and 12, the convex, straight and concave virtual planes of the faces 24, 25 and 26 intersect the teeth of the faces 440, 450 and 460. The height of the teeth of each face 440, 450 and 460 can therefore be altered while maintaining a convex, straight and concave overall shape of the said virtual faces 24, 25 and 26 respectively. Likewise, the shape of the notches may differ from a concave shape, but it is the latter shape that gives the best results in terms of pull-out strength.

It is possible to create several teeth depending on the radius of the drill bit used, the amount of material removed and the length of the crimping faces.

Advantageously, at least three teeth are created per crimping face using a drill bit 3 mm in radius. In other words, at least four notches are formed per crimping face.

This is because the applicant company has found to its great surprise that by adding teeth in comparison with a curved punch with just one or two teeth per crimping face, the force needed for crimping was the same (for a drill bit 2.5 mm in radius) or even lower (by around 8% for a drill bit 3 mm in radius) whereas the pull-out strength was very markedly improved (more than 35% for a drill bit 3 mm in radius and more than 48% for a drill bit for 2.5 mm in radius).

The presence of teeth on the crimping faces 240-250-260 or 440-450-460 provides a very marked improvement in the pull-out strength of the crimped joints, while at the same time limiting the force that is needed to make each crimped joint.

Thus, pull-out tests were conducted using the following punches:

E1: a punch comprising a plain smooth convex crimping face 24 and a plain smooth concave crimping face 26, according to FIG. 3;

E2: a punch comprising a convex crimping face 240 and a concave crimping face 260 each one provided with one tooth (two notches) made with a drill bit with a radius of 3 mm;

E3: a punch comprising a convex crimping face 240 and a concave crimping face 260 each one provided with two teeth (three notches) made with a drill bit with a radius of 3 mm;

E4: a punch comprising a convex crimping face 240 and a concave crimping face 260 each one provided with three teeth (four notches) made with a drill bit with a radius of 3 mm;

E5: a punch comprising a convex crimping face 240 and a concave crimping face 260 each one provided with four teeth (five notches) made with a drill bit with a radius of 3 mm;

E6: a punch comprising a convex crimping face 240 and a concave crimping face 260 each one provided with two teeth (three notches) made with a drill bit with a radius of 2.5 mm;

E7: a punch comprising a convex crimping face 240 and a concave crimping face 260 each one provided with three teeth (four notches) made with a drill bit with a radius of 2.5 mm;

E8: a punch comprising a convex crimping face 240 and a concave crimping face 260 each one provided with four teeth (five notches) made with a drill bit with a radius of 2 mm;

E9: a punch comprising a convex crimping face 240 and a concave crimping face 260 each one provided with five teeth (six notches) made with a drill bit with a radius of 1.5 mm.

As illustrated in FIG. 14, the crimping forces were measured with the punches E1 to E9 mounted on an "ERGOTOP" model pair of pliers 800 of the EDMA™ make, to produce a single crimped joint between two galvanized steel section piece rails $R_i$ and $R_s$ 0.7 mm thick of the STIL® F530 make marketed by the company PLACO SAINT GOBAIN. One, 801, of the handles of the pliers 800 is immobilised in a vice 850 and the other handle 802 is pivoted in the direction of the arrow F1 by a bearing wheel 900 connected to a hydraulic cylinder (not illustrated) coupled to a force sensor (not illustrated) of the SENSY make ref: 2960-20KN-0.1, serial number 2120127000, calibration certificate dated Sep. 7, 2013.

The maximum force (in kilogram force) needed to make the crimped joint between the two rails is measured over an actuator travel Lv of 300 mm, between a position at 0 mm (illustrated in FIG. 13) in which the bearing wheel 900 is a distance away from the handle 802 of the pliers 800 and a 300 mm position in which the handle 802 of the pliers 800 has been fully pivoted by the bearing wheel corresponding to a maximum penetration of the punch into the rails (crimping position).

Moreover, the pull-out measurements made on crimped joints produced with the punches E1 to E9 involved making a single crimped joint between two galvanized steel profile section rails 0.7 mm thick of the STIL® F530 make marketed by the company PLACO SAINT GOBAIN, then measuring the maximum force needed to achieve separation of the two rails, i.e. to pull the crimped joint apart, using a Kern model HCB hanging scale version 3.1 July 2006. The setup is identical to that described in conjunction with FIGS. 5 and 6.

The results are reported in the Table below and the configuration of the punches E1-E9 are shown in FIG 16.

| Type of punch | Value of radius | Number of teeth | Maximum force needed for crimping (DaN) | Maximum force needed for pulling apart (DaN) |
|---|---|---|---|---|
| E1 | 0 | 0 | 22 | 7 |
| E2 | 3 | 1 | 31.7 | 31 |
| E3 | 3 | 2 | 31.7 | 32 |
| E4 | 3 | 3 | 29.3 | 41.7 |
| E5 | 3 | 4 | 26.8 | 33 |
| E6 | 2.5 | 2 | 34.1 | 42 |
| E7 | 2.5 | 3 | 31.7 | 46 |
| ES | 2 | 4 | 29.3 | 41 |
| E9 | 1.5 | 5 | 24.4 | 33 |

On the whole, creating teeth on the convex face and the concave face of the punch according to the invention improves the pull-out strength of the punch by around 300 to 550% whereas the crimping force is, by the same token, increased by only around 10 to 50%.

In more detail, it would seem that, for the same number of teeth, it is preferable to use a drill bit having a radius of 2 to 2.5 mm rather to than a drill bit with a radius of 3 mm. Thus, for 2 and 4 teeth, the maximum force needed for pulling apart increases by 24 to 30%, whereas the force needed for crimping increases by only 7 to 9% (tests E3-E6 and E5-E8).

If the maximum force needed for pulling apart is the key factor considered, then it is appropriate to provide three teeth (four notches) on each face (tests E4 and E7). With two crimpings performed using such a punch, the pull-out strength obtained will be equal to, if not greater than, that obtained by using a screw to secure the rails.

Nevertheless, while it is possible to produce four teeth (five notches) using a drill bit 3 mm in radius on a punch suited to standard tools, it is found that the pull-out strength reduces.

By using a drill bit 3 mm in radius, the tooth set needs to comprise fewer than four teeth. Advantageously it comprises two or three teeth, preferably three teeth because the pull-out strength is higher whereas, astonishingly, the force needed for crimping is almost 8% lower than that needed for a punch that has two teeth per face.

By using a drill bit with a radius of less than 3 mm, for example 2 mm, 2.5 mm or 1.5 mm, the number of teeth can increase and be as high as four with a 2 mm drill bit and as high as five with a 1.5 mm drill bit.

A punch in accordance with test E9 exhibits the advantage of requiring a crimping force that is only 10% higher than that of a smooth plain curved punch (without teeth) according to test E1, whereas the maximum pull-out force increases by 370%.

The curves of FIG. 14 illustrate the force necessary for crimping as a function of a travel Lv of the actuating cylinder of the setup of FIG. 14 and punches according to the invention comprising different numbers of teeth.

The curve in solid line illustrates the force needed for crimping using a curved punch according to the invention and having no teeth. After an increasing first phase (between 30 and 100 mm of travel Lv) corresponding to the piercing of the metal sheets with the end of the punch, the force needed for crimping reaches a plateau at around 22 DaN. This corresponds to the progression of the plain smooth faces of the punch in the crimping of the metal sheets. Because the faces are plain smooth (without teeth) the crimping force remains constant.

The curve in dashed line illustrates the force needed for crimping with a curved punch according to the invention provided with two teeth (i.e. three notches) per crimping face.

Like with the smooth plain punch, the curve exhibits an increasing first phase (between 30 and 100 mm of travel Lv) corresponding to the piercing of the metal sheets with the end of the punch.

The force needed for crimping then decreases, corresponding to the passage of the first notch into the crimp (between 130 mm and 150 mm of travel Lv) down to a minimum of 10 DaN. The force required for crimping then increases ending at a maximum force of around 34 DaN. This phase is situated between around 150 mm and 290 mm of travel Lv and corresponds to the passage of the first tooth into the crimp.

In the same way, the passage of the second notch, the second tooth and the third notch respectively correspond to a phase in which the force required for crimping decreases, increases and decreases.

Although the maximum force needed for crimping is considerably higher with a toothed punch than with a plain smooth punch, the average force, measured after piercing (after 100 mm of travel Lv), is very similar between the two punches, while at the same time a toothed punch provides a very much higher pull-out strength.

The curves in dotted line and in mixed line illustrate the force required for crimping with a curved punch respectively provided with three teeth and with four teeth per crimping face.

Each curve has as many spikes as there are teeth and as many troughs as there are notches.

By comparing the curves of the toothed punches it can be seen that as the number of teeth increases so the maximum force needed for crimping decreases. The average force itself remains similar to that obtained with a plain smooth punch.

The invention thus makes it possible to provide a curved punch that is highly effective in terms of pull-out strength by comparison with a straight punch comprising two rectilinear crimping faces.

The invention also makes it possible to provide a toothed curved punch which is highly effective in terms of pull-out strength and requires an average crimping force similar to that of a plain smooth curved punch.

The invention claimed is:

1. Punch (20) for a crimping tool, comprising a fixing part (21) for fixing to the tool and a punching part (22) consisting of a spike (23) connected to the fixing part (21) by a first (24) and a second (25) crimping face, characterized in that the first crimping face (24) exhibits a convex primary profile and a secondary profile comprising at least two teeth (241, 251, 351, 451, 551).

2. Punch according to claim 1, in which the second crimping face (25) exhibits a rectilinear primary profile.

3. Punch according to claim 1, in which the second crimping face (26) exhibits a concave primary profile.

4. Punch according to claim 1, in which the spike (23) is centered with respect to the first (24) and second (25, 26) crimping faces.

5. Punch according to claim 1, in which the punching part (22) exhibits a height ($H_{22}$) of between 1 and 2 cm, a width ($L_{22}$) of between 1 and 2 cm, and the convex first crimping face (24) exhibits a radius of convex curvature ($R_{24}$) of between 4 and 6.

6. Punch according to claim 3, in which the concave second crimping face (26) exhibits a radius of concave curvature ($R_{26}$) of between 3 and 4 cm.

7. Punch according to claim 1, in which each crimping face exhibits a secondary profile comprising at least two teeth (251, 351, 451, 551).

8. Punch according to claim 7, in which the teeth (251, 351, 451, 551) are spaced each from the other by a concave notch (600) exhibiting a radius of concave curvature ($R_{600}$) of between 1.5 and 3 mm.

9. Crimping tool for crimping two components together, comprising two jaws ($M_1$, $M_2$) articulated one with respect to the other relative to a pivot (P), between an open position for positioning them one on each side of the components that are to be crimped, and a closed position at the end of crimping, characterized in that one of the jaws bears a punch according to claim 1 and the other jaw exhibits a die that accommodates the punch when the two jaws are in the closed position.

10. Crimping tool according to claim 9, in which the punch is configured in such a way that the spike is positioned between the pivot and the convex first crimping face.

11. Punch according to claim 1, further comprising between three and five teeth.

12. Punch according to claim 5, wherein the height ($H_{22}$) is 1,4 cm, the width ($L_{22}$) is 1.4 cm, and the radius of convex curvature ($R_{24}$) is 5 cm.

13. Punch according to claim 6, wherein the radius of concave curvature ($R_{26}$) is 3.7 cm.

14. Punch according to claim 7, wherein the secondary profile comprises between three and five teeth.

15. Punch according to claim 14, wherein the secondary profile comprises three teeth.

16. Punch according to claim 8, wherein the radius of concave curvature ($R_{600}$) is between 2.5 and 3 mm.

* * * * *